United States Patent [19]

Whitener

[11] 3,996,850

[45] Dec. 14, 1976

[54] COTTON GIN PRESS DOGS

[76] Inventor: Rufus A. Whitener, P.O. Box 219, Wolfforth, Tex. 79382

[22] Filed: July 31, 1975

[21] Appl. No.: 600,878

[52] U.S. Cl. ..... 100/220; 100/223

[51] Int. Cl.[2] ..... B30B 15/00

[58] Field of Search ..... 100/35, 220, 223

[56] References Cited

UNITED STATES PATENTS

| | | | |
|---|---|---|---|
| 1,521,865 | 1/1925 | Cameron | 100/220 |
| 1,553,434 | 9/1925 | Cameron | 100/220 |
| 1,726,935 | 9/1929 | Tate | 100/220 |
| 2,139,928 | 12/1938 | Blewett | 100/220 |
| 2,209,740 | 7/1940 | Steinhauer | 100/220 X |
| 2,241,006 | 5/1941 | Smith | 100/220 X |
| 2,757,601 | 8/1956 | Deems | 100/220 X |
| 2,822,750 | 2/1958 | Austin | 100/220 |
| 3,583,312 | 6/1971 | Van Doorn | 100/220 X |
| 3,796,150 | 3/1974 | Van Doorn | 100/220 X |

*Primary Examiner*—Billy J. Wilhite
*Attorney, Agent, or Firm*—Wendell Coffee

[57] ABSTRACT

Individual press dogs are attached individually to a cotton gin press box. Each dog is biased by a weighted hammer against an anvil held in place by springs. Each dog is released when the pressure on that dog overcomes the resistance of the springs.

2 Claims, 4 Drawing Figures

COTTON GIN PRESS DOGS

BACKGROUND OF THE INVENTION

1. Field of the Invention

This invention relates to cotton ginning and more particularly to press dogs at the press wherein the cotton is compressed, wrapped and tied.

2. Description of the Prior Art

Traditionally, after the cotton has been processed at a gin, it is tramped into a press box. Two press boxes are mounted upon a turntable. When a bale of cotton is tramped into one press box, the turntable is rotated, bringing an empty box to the tramper. The box containing a full bale of cotton is brought over a hydraulic press ram wherein the bale of cotton is pressed into the upper portion of the box. The top of the box is then broken open and the wrapping and tying of the bale is completed.

Dogs are used in the upper portion of the box so that each stroke or each time the cotton is tramped down in the press box, the dogs engage the top of the cotton to prevent the cotton from expanding and following the tramper back up. Then when the turntable is rotated and the cotton is pressed, it is necessary to pull the dogs from the box to permit the cotton to expand up to the top of the press.

Traditionally, these dogs have "fingers" which extend through slots in the side of the box to engage the cotton. Each dog, besides the fingers, has a weight which, by gravity, tends to flip the dog in a horizontal position. The action is that when the tramper pushes down upon the cotton, the dogs are pushed down and then when the tramper passes by, the weights push the fingers back to horizontal position and the weights bear against the side of the box to prevent the fingers from rising or flipping up. Then, when the box is moved by the turntable to the press position, a common eccentric shaft or common crankshaft carrying all the dogs is rotated to remove the dogs from an engaged position so the fingers are withdrawn from the box, permitting the cotton to rise.

Of course, there have been variations of this. E.g., from about 1935 to about 1950 the Murray Company, Dallas, Texas, marketed a Down Packing Double Box Press. The cotton was tramped downward and, also, the cotton was pressed downward. The bottom of the press box opened for wrapping and tying the bale and removing it. In this case, it was necessary only for the dogs to hold the cotton down inasmuch as the press block moved downward as well as the tramper. Therefore, they were able to use dogs each of which were individually mounted to the side of the box.

AUSTIN et al., U.S. Pat. No. 2,822,750, discloses a press box wherein each of the dogs is mounted on a straight shaft and the shaft mounted by a short crank arm to another straight shaft and the two shafts held so the dogs are engaged by springs. The dogs were all mounted on a common shaft and upon release, the dogs all acted in unison.

TATE, U.S. Pat. No. 1,726,935, discloses a similar system wherein all of the dogs are on a common a shaft and instead of using a weight to flip the springs, he uses a spring. TATE discloses two springs, one for operating in each direction for the entire series of dogs for one side.

BLEWETT, U.S. Pat. No. 2,139,928, discloses a plurality of dogs, all the dogs being attached to a single shaft and the shaft controlled by a single spring acting against a cam follower. A special shaped cam on the shaft controlled the dogs in the desired manner.

DEEMS, U.S. Pat. No. 2,757,601, discloses a system having a plurality of dogs on a single shaft and operating with either a spring system or hydraulic system.

In addition to the above mentioned patents, applicant was familiar at the time of the preparation of this patent application with the two VanDOORN patents, U.S. Pat. Nos. 3,583,312 and 3,796,150; the DOLAN patent, U.S. Pat. No. 962,555; TAYLOR U.S. Pat. No. 3,195,447, and BLEASDALE U.S. Pat. No, 3,882,770.

In recent times, there have been developments which had made it desirable to change the size of the press boxes that existed in many gins. This has necessitated in changing the press dogs.

SUMMARY OF THE INVENTION

1. New and Different Function

I have invented a press dog which is particularly adapted to be attached to press boxes as they are modified. In my system, each press dog is individually attached to the press box and it is a self-contained unit. My system not only simplifies the construction of the dog and simplifies its installation onto the press box, but it also improves the operations since the operation of any one dog is in no way dependent upon the operation of the other dogs. In my system, the dog uses a hammer or weight to return the finger to the holding position when it is tramping. However, the anvil against which the weight operates is spring biased so that the entire anvil and dog trip downward upon the pressure used to compress the bale.

2. Objects of this Invention

An object of this invention is to tramp cotton into a box, hold it and then release it on compression.

Another object is to provide an individual press dog which will automatically release upon the compression pressures.

Other objects are to achieve the above with a device that is sturdy, compact, durable, lightweight, simple, safe, efficient, versatile, and reliable, yet inexpensive and easy to manufacture, install, adjust, operate, and maintain.

Further objects are to achieve the above with a method that is versatile, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not necessarily to the same scale.

DESCRIPTION OF THE PREFERRED EMBODIMENT

Figure 2:
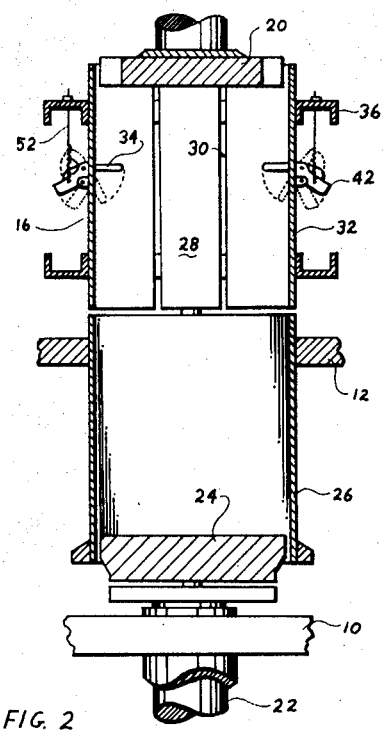
FIG. 2 is a sectional view of the press box taken substantially on line 2—2 of FIG. 1.
Figure 1:
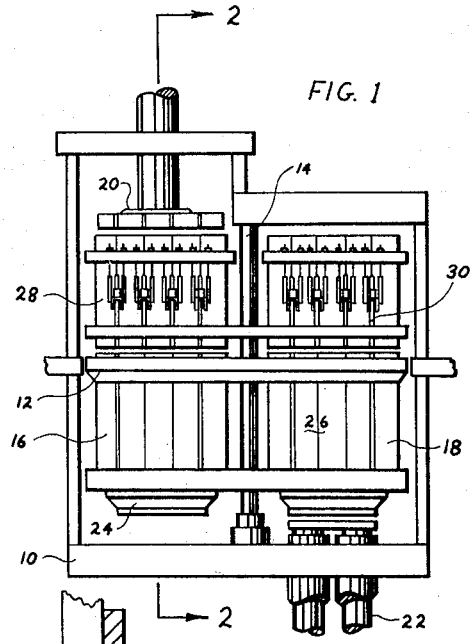
FIG. 1 is a side elevational view of a press box with an embodiment of my invention thereon.

Referring to the drawing and particularly to FIGS. 1 and 2, there may be seen a press box as typically installed at a cotton gin. It will be understood that there is a framework or part of the foundation structure 10. To this is mounted turntable 12, which is mounted upon main post 14. Two identical press boxes 16 and 18 are mounted diametrically opposed upon the turntable. As shown, the box 16 is beneath tramper 20 which is a tramper means over the box for tramping cotton downwardly within the box. The box 18 is over hydraulic rams 22 which form a major portion of the press means under the box for compressing cotton upward in the box. The rams 22 act through press blocks 24 which normally rest in the bottom of each box upon flanges. The boxes themselves have lower portion or lower box 26 and upper portion or upper box 28. The upper box has vertical slots 30 between the structural members 32 and fingers 34 which extend between the slots 30 are for the purpose described.

It will be understood that all of the equipment specifically described to this point is old, well known and conventional as generally described and is not my invention. E.g., the mechanism by which the turntable is locked in place, the details of the operation of the rams and the tramper, etc., have not been described since those skilled in the art know their operation without a detailed description thereof. The structural details of the boxes themselves is not described except inasmuch as there is beam 36 extending along the various structural elements 32 forming a side of the box. This beam could take various forms such as a channel shape shown in FIGS. 1 and 2 or a Z-shape as shown in FIG. 3.

Figure 3:
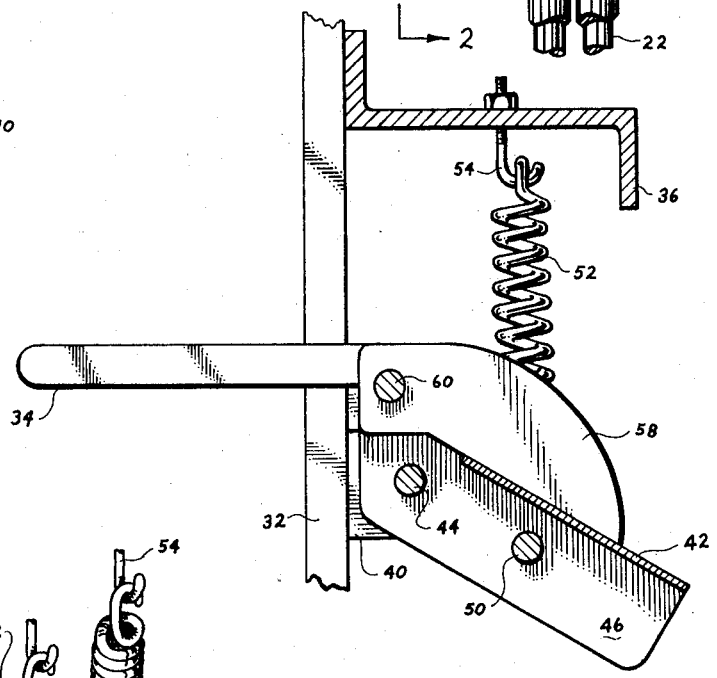
FIG. 3 is a sectional view of the press dog attached to the box according to my invention.
Figure 4:
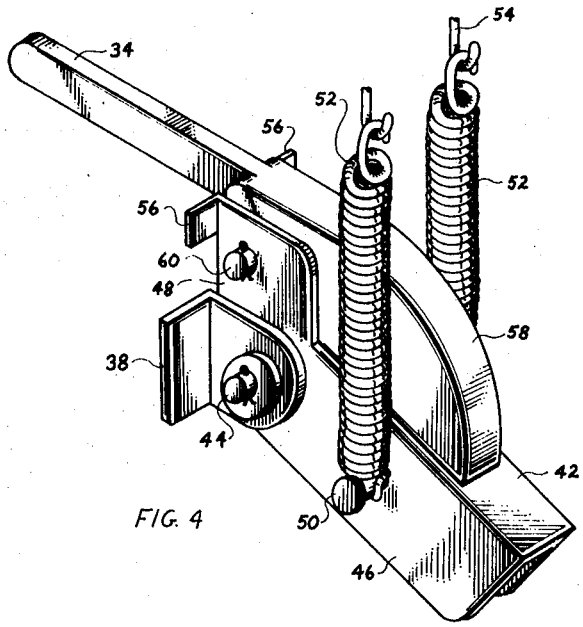
FIG. 4 is a perspective view of the dog according to this invention unattached.

Particular reference is made to FIGS. 3 and 4 showing my invention, which is particularly adapted to be attached to the existing boxes. Two ears 38 and 40 are attached to the members 32 of the side of the box. If the box is made of steel, the ears are readily welded to the side of the box. In the event the box were even of wood, the ears can be readily bolted to the side of the box. Those skilled in the art will understand how to drill holes in the ears 38 and 40 and the structural members 32 to bolt them onto the box although this has not been specifically illustrated in the drawing. Anvil 42 is pivoted by bolt 44 between the ears 38 and 40. The anvil 42 is somewhat shaped as a bell crank having long leg 46 extending outwardly from the bolt 44 and biforcated short legs 48 extending upwardly from the bolt 44.

Peg 50 extends through the long leg 46 and has spring 52 on each side thereof extending upwardly and attached by hook 54 to the beam 36. The tension of the spring 52 will hold stops 56 formed on the upper portion of the short legs 48 firmly against the members 32 on the side of the box. Thus it may be seen that the spring 52 urges the anvil 42 upward and the stops 56 limit the upward travel of the anvil.

The finger 34 extends from inside the box to outside the box where it is thickened to form hammer or weight 58. The finger and weight together are an integral element and pivoted by bolt 60 between the upper short legs 48 of the anvil 42. Those skilled in the art will understand that bolts 44 and 60 could be threaded to receive nuts rather than being drilled and fitted with cotters as illustrated.

During tramping, the cotton pushing down on the finger 34 raises the weight 58, the finger and weight pivoting about the bolt 60. When the tramper 20 is past the finger 34, the weight 58 will bring the finger back to the horizontal position to hold the cotton upon the upper travel of the tramper.

After the tramping is completed and the boxes are rotated and the cotton is pressed, the excess pressure from the press means operating under the finger 34 will cause anvil 42, weight and finger all to rotate as a unit about the bolt 44 so the finger is raised and the cotton is pressed against the top of the press.

As an aid to correlating the terms of the claims to the exemplary drawing, the following catalog of elements is provided:

| | |
|---|---|
| 10 foundation | 36 beam |
| 12 turntable | 38 ear |
| 14 post | 40 ear |
| 16 press box | 42 anvil |
| 18 press box | 44 bolt |
| 20 tramper | 46 long leg |
| 22 rams | 48 short leg |
| 24 press block | 50 peg |
| 26 lower box | 52 spring |
| 28 upper box | 54 hook |
| 30 slots | 56 stops |
| 32 members | 58 weight |
| 34 fingers | 60 bolt |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In a cotton gin press box having:

a. a turntable, b. two diametrically opposed boxes on the turntable, c. tramper means over one of the boxes for tramping cotton downward therein, d. press means under the other of the boxes for compressing cotton upward therein, and e. said turntable rotatable so that the boxes may be interchanged, f. the improved structure for holding the cotton down as tramped comprising:

g. two ears attached to the outside of the box, h. an anvil pivoted between the ears, j. at least one spring extending from the anvil to the box urging the anvil upward, k. a stop on the anvil for limiting the upward travel, m. a dog n. pivoted to the anvil, o. the dog having a finger extending into the box for holding the cotton down, and p. the dog having a weight bearing against the anvil outside the box.

2. The invention as defined in claim 1 wherein there are a plurality of structures for holding the cotton down as defined in subparagraphs (g) through (p).

* * * * *